US008686275B1

(12) United States Patent
Stahnke

(10) Patent No.: US 8,686,275 B1
(45) Date of Patent: Apr. 1, 2014

(54) PEDAL ACTUATOR WITH NONLINEAR SENSOR

(76) Inventor: Wayne Lee Stahnke, Reno, NV (US)

( * ) Notice: Subject to any disclaimer, the term of this patent is extended or adjusted under 35 U.S.C. 154(b) by 720 days.

(21) Appl. No.: 12/008,896

(22) Filed: Jan. 15, 2008

(51) Int. Cl.
*G10H 1/00* (2006.01)

(52) U.S. Cl.
USPC ..... 84/718; 84/721; 84/723

(58) Field of Classification Search
USPC ..... 84/718–721, 723
See application file for complete search history.

(56) References Cited

U.S. PATENT DOCUMENTS

| | | | | |
|---|---|---|---|---|
| 5,451,708 | A * | 9/1995 | Fujiwara et al. | 84/21 |
| 5,568,138 | A * | 10/1996 | Mantani | 341/20 |
| 5,652,399 | A * | 7/1997 | Fujiwara et al. | 84/21 |
| 5,714,702 | A * | 2/1998 | Ishii | 84/462 |
| 5,739,450 | A * | 4/1998 | Fujiwara et al. | 84/462 |
| 6,201,173 | B1 * | 3/2001 | Black | 84/422.1 |
| 6,359,207 | B1 * | 3/2002 | Oba et al. | 84/658 |
| 6,737,572 | B1 * | 5/2004 | Jameson et al. | 84/741 |
| 6,969,791 | B2 * | 11/2005 | Fujiwara | 84/13 |
| 6,992,241 | B2 * | 1/2006 | Fujiwara | 84/21 |
| 7,238,873 | B2 * | 7/2007 | Fujiwara et al. | 84/600 |
| 7,285,715 | B2 * | 10/2007 | Sasaki et al. | 84/737 |
| 7,473,841 | B2 * | 1/2009 | Fujiwara | 84/615 |
| 7,557,280 | B2 * | 7/2009 | Fujiwara | 84/13 |
| 7,598,448 | B2 * | 10/2009 | Ohba | 84/626 |
| 8,138,407 | B2 * | 3/2012 | Matahira et al. | 84/610 |
| 8,273,977 | B2 * | 9/2012 | Uehara | 84/609 |
| 2002/0059862 | A1 * | 5/2002 | Muramatsu et al. | 84/719 |
| 2003/0070526 | A1 * | 4/2003 | Muramatsu et al. | 84/21 |
| 2005/0145087 | A1 * | 7/2005 | Fujiwara | 84/1 |
| 2005/0211048 | A1 * | 9/2005 | Fujiwara | 84/13 |
| 2005/0211049 | A1 * | 9/2005 | Fujiwara et al. | 84/13 |
| 2006/0021488 | A1 * | 2/2006 | Fujiwara et al. | 84/13 |
| 2006/0053999 | A1 * | 3/2006 | Sasaki | 84/13 |
| 2006/0156905 | A1 * | 7/2006 | Sant | 84/600 |
| 2006/0185503 | A1 * | 8/2006 | Fujiwara | 84/626 |
| 2006/0201313 | A1 * | 9/2006 | Sasaki et al. | 84/626 |
| 2006/0213357 | A1 * | 9/2006 | Ohba | 84/723 |
| 2007/0256550 | A1 * | 11/2007 | Muramatsu | 84/719 |
| 2008/0072743 | A1 * | 3/2008 | Ohba et al. | 84/616 |
| 2008/0156181 | A1 * | 7/2008 | Sasaki | 84/743 |
| 2008/0202322 | A1 * | 8/2008 | Ishii | 84/633 |
| 2010/0162872 | A1 * | 7/2010 | Matahira et al. | 84/13 |
| 2011/0185876 | A1 * | 8/2011 | Fujiwara et al. | 84/21 |

* cited by examiner

*Primary Examiner* — David S. Warren

(57) ABSTRACT

A piano is equipped with an actuator that moves the piano pedal mechanism in a manner that reproduces the pedaling effects of an original performance with high accuracy. The actuator comprises a solenoid, a permanent magnet, a velocity sense coil, and a Hall-effect sensor. The Hall-effect sensor provides an indication of the displacement of the solenoid plunger in accordance with an inverse-square law. Closed-loop feedback control is provided to effect a very true reproduction of pedaling effects. Automatic calibration allows for simple installation.

73 Claims, 9 Drawing Sheets

PEDAL ACTUATOR WITH NONLINEAR SENSOR

BACKGROUND OF THE INVENTION

1. Field of the Invention

The present invention relates to a system and method for controlling mechanically-driven musical instruments, and in particular to a system and method for controlling the pedaling of a mechanically-driven piano or other instrument.

2. Background of the Technology

Beginning with the invention of pneumatically-driven reproducing pianos in the early twentieth century, systems and methods have been developed for recording music played by a human pianist and for reproducing that music on a piano. In modern reproducing pianos, music played by a human pianist may be recorded on a recording medium such as a Compact Disc or the like, and the recorded music may be recreated, for example, using actuators to drive the keys and pedals of the piano. Many reproducing pianos have attempted to reproduce the subtle pedaling effects of the original performance.

One way of controlling the pedals in a reproducing piano is described and illustrated in U.S. Pat. No. 4,450,749 to Stahnke issued May 29, 1984, which is hereby incorporated by reference in its entirety. That method and apparatus provide in the reproduced performance a very accurate reproduction of the pedaling effects in the original performance. During the original performance, the instantaneous position of the pedal mechanism (e.g. the damper lifter tray in a grand piano, or the actuator bar in a vertical piano) is sensed and recorded. At a later time when the performance is reproduced, the actuator positions the pedal mechanism in such a way that the dampers are positioned in substantially the same way they were positioned during the original performance. This method of "position pedaling" gives excellent results, but a very high price, because it requires a linear potentiometer and very accurate adjustments. The output signal from such a linear potentiometer is a linear function of the actual or achieved position of the pedal mechanism itself.

Position pedaling using a linear potentiometer requires costly hardware. In addition, installing and adjusting a mechanism including a linear potentiometer is difficult and may require specialized tools. These defects are particularly problematic for so-called "piano kits," which include electrical and mechanical parts that are designed to be retrofitted into existing pianos. Ideally, piano kits should be easy to install, because the kits may be fitted into the pianos, by technicians having a wide range of skills and tools.

One approach designed to reduce cost and simplify installation is described in U.S. Pat. No. 5,016,513 to Stahnke issued May 21, 1991, which is incorporated herein by reference in its entirety. That method and apparatus provide an approximation to pedaling effects that is relatively cost effective and easy to install. However, that approach suffers from decreased accuracy in the pedaling effects.

There is an unmet need in the art for a pedal assembly that provides accurate reproduction of pedaling effects at reduced cost. There is a further unmet need in the art for a pedal assembly that provides accurate reproduction of pedaling effects, while allowing for simpler installation.

SUMMARY OF THE INVENTION

It is an object of the present invention to provide a low-cost, highly accurate pedal assembly. It is a further object of the invention to provide a control mechanism capable of controlling the operation of such assembly. It is a further object of the invention to provide automatic calibration of a pedal assembly, eliminating the necessity for operator assistance and thus allowing for simpler installation.

A pedal assembly may consist of an actuator, which moves mechanical portions of a piano to recreate pedaling effects; and a sensor, which provides information about the position of the actuator. In operation, musical performance information is received, for example, from a Compact Disc, computer memory, a network, or the like. The musical performance information is used to calculate a commanded position. The commanded position is, for example, a desired position of the actuator. The commanded position is compared to the output of the sensor. Based on this comparison, a drive is calculated and provided to the actuator to move the actuator to the commanded position.

Various sensors may be used in embodiments of the invention. The sensor used may be, for example, a nonlinear sensor, such as a Hall-effect sensor, an optical sensor, or the like. In one implementation, a Hall-effect sensor may be used as the sensor, which may reduce the cost of the pedal assembly. Reference to a Hall-effect sensor will be made throughout. However, those skilled in the art will appreciate that other types of sensors are equally well suited to the task, for example, optical sensors or other nonlinear sensors. Thus, the term "Hall-effect sensor" is intended to be interchangeable with the term "nonlinear sensor" throughout.

Nonlinear sensors, such as Hall-effect sensors, differ from linear potentiometers in several ways. Most notably, when used in a pedal assembly, the output voltage of a Hall-effect sensor is not a linear function of the position of the pedal mechanism. Rather, the output voltage of a Hall-effect sensor is highly nonlinear, and thus, the Hall-effect sensor cannot be used to directly measure the position of the pedal mechanism. Therefore, embodiments of the present invention include a control mechanism that allows the commanded position to be effectively compared to the output of the sensor.

In one implementation, the control mechanism accepts the output of the Hall-effect sensor, and calculates a "linearized sensor output," which can be effectively compared to the commanded position. In another implementation, the control mechanism accepts the commanded position, and calculates a "Hall-modified commanded position," which can be effectively compared to the output of the Hall-effect sensor. The results of the comparison may be used to calculate a drive, which is applied to the actuator to move it into the commanded position.

In an alternate embodiment of the invention, systems and methods for performing calibration of a pedal assembly are provided. Calibration may be performed by first withdrawing drive from the actuator and subsequently providing a full drive to the actuator (or vice versa), measuring the Hall-effect sensor output for both positions. The measured Hall-effect sensor outputs may be used to calculate constants. In one implementation, the constants are used directly in operation of the pedal assembly. In another implementation, the constants are used to create a lookup table, which is used in operation of the pedal assembly. The calibration process can be fully automated, resulting in a pedal assembly that is simple to install and maintain.

DETAILED DESCRIPTION

Embodiments of the invention provide systems and methods for driving one or more pedaling assemblies in a piano or other musical instrument. During playback of a musical performance, an actuator effects movement of a pedal mechanism. A sensor, such as a Hall-effect sensor, is used to provide information about the position of the pedal mechanism. The Hall-effect sensor does not directly measure the position of the pedal mechanism. Control logic uses the output of the Hall-effect sensor to calculate a desired drive, which is provided to the actuator.

Example embodiments will now be described in conjunction with the following figures.

Figure 1:
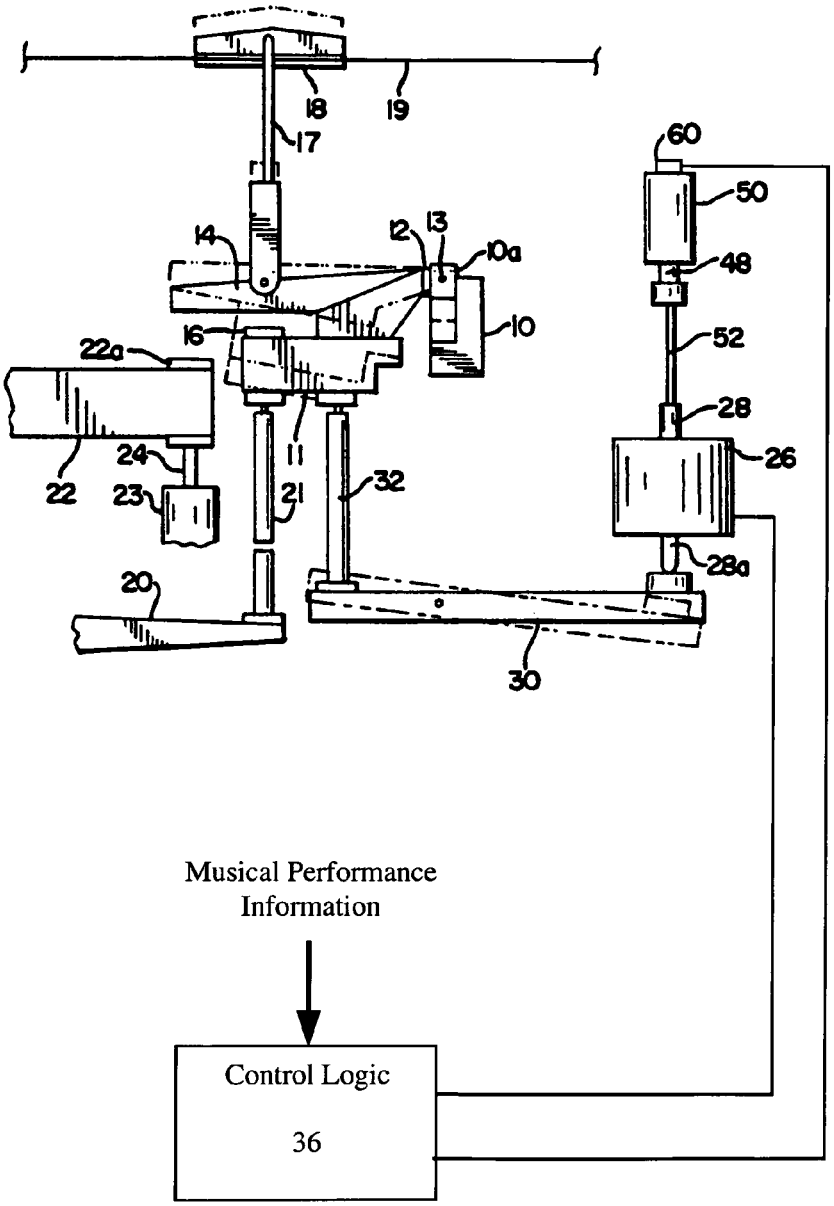
FIG. 1 is a schematic illustration of the basic piano pedal mechanism in a reproducing piano employing the method and apparatus of the present invention to reproduce the pedal mechanism movements of an original performance.

In FIG. 1, there are illustrated several basic components of the pedal mechanism in a typical piano such as a grand piano. This particular view is a side view. Extending approximately the width of the piano is a fixed rail 10, having a hinge member 10*a* affixed thereto. In FIG. 1, only one such hinge member 10*a* is shown, however it will be appreciated that there is a hinge member at each end of the fixed rail 10 and usually one or more between the ends. A damper lifter tray 11 also extends substantially the width of the piano, and has several end hinge members 12 (only one of which is shown in FIG. 1), each of which corresponds to and is joined to the corresponding hinge member 10*a* of the fixed rail by means of a horizontal hinge pin 13. The damper lifter tray is thus movable about the horizontal pivotal axis of the hinge pins 13 between the positions illustrated in solid lines in FIG. 1 and the position illustrated in dotted lines.

Above the damper lifter tray 11 is a damper lifter 14 which is also hingedly connected to a hinge member (not shown) affixed to the fixed rail 10 along the horizontal pivotal axis of the hinge pins 13. Thus the damper lifter 14 will be lifted upwardly and pivoted about the same axis as the damper lifter tray 11 between the solid line and dotted line positions illustrated in FIG. 1. The damper lifter tray has a felt pad 16 which extends the length of the damper lifter tray for engaging the underside of the various damper lifters 14. Each damper lifter 14 is connected through a damper wire 17 to a damper 18 adapted to engage piano strings 19. For each set of piano strings representing a note of the piano to be damped, there is a damper 18, a damper wire 17 and a damper lifter 14.

The piano sustaining pedal 20 is coupled to the underside of the damper lifter tray 11 by means of trapwork 21. Thus when the pedal 20 is depressed, it will rotate about its pivotal mounting to lift by means of the trapwork 21 the damper lifter tray 11, causing the latter to rotate about its horizontal axis as defined by the hinge pins 13. This pivotal movement of the damper lifter tray causes all of the damper lifters 14 to raise the dampers 18 from the strings 19. This is so because the damper lifter tray extends the entire width of the notes to be damped, under all of the damper lifters 14, and thus all of the damper lifters accordingly will be lifted simultaneously.

Since each of the damper lifters is associated with an individual set of piano strings representing a note of the piano, each is associated with an individual piano key 22 having a felt pad 22*a* which is adapted to engage the end of the damper lifter 14 when the key is depressed and the end of the key illustrated in FIG. 1 is pivoted upwardly. Thus the striking of the piano key will momentarily lift the damper 18 from the piano strings 19 with which the particular key and damper are associated. Since the piano illustrated in FIG. 1 is a reproducing piano, appropriate actuating means such as the solenoid coil 23, acting through a conventional pusher rod 24, moves the key to effect striking of the piano strings by the appropriate hammers (not shown) in response to recorded signals.

In the particular reproducing piano illustrated, there is means for moving the pedal mechanism, i.e., the damper lifter tray, the damper lifter, and the damper, between the dotted line and solid line positions automatically in response to recorded signals. This is done by means of an actuator. In the implementation shown in FIG. 1, the actuator comprises a solenoid 26 having a plunger 28 which has a tip 28*a*. However, those skilled in the art will appreciate that other actuators can be used. The plunger tip 28*a* engages a lever 30, and through the medium of the trapwork 32 is able to move the damper lifter 14 and the other portions of the pedal mechanism between their solid line and dotted line positions as illustrated in FIG. 1. Various alternate interconnections can be made between the plunger 28 and the damper lifter 14 to accomplish this movement of the damper lifter and the other portions of the pedal mechanism. The particular connection described and illustrated is only one example of this connection, and this structure thus far described is conventional in reproducing pianos.

The illustrated structure of the pedal mechanism is conventional in a grand piano. However, in the case of a vertical or upright piano, the dampers 18 are controlled by a damper actuator bar as opposed to a damper lifter tray. In connection with the soft pedal mechanism, the entire piano key frame in a grand piano is moved laterally so that only two of the set of three strings (or one of the set of two strings) will be struck by the hammer when the key is depressed, and thus, a softer note will result. Thus, the key frame and its operational mechanisms which are laterally movable to achieve this soft play function may be considered the pedal mechanism in this description, all of which is conventional. The solenoid 26 and its plunger 28 would be operatively connected to the piano key frame to effect lateral movement of the key frame for operation of the soft pedal mechanism.

A magnet 48, for example, a rare-earth magnet, is movable within a sense coil 50. The magnet 48 in the illustrated embodiment is connected to the plunger 28 of the solenoid 26 by means of a connecting arm 52. Since the movement of the plunger 28 is in accordance with the movement of the pedal mechanisms, including the damper lifter tray 11, it has been found convenient to connect the magnet 48 directly to the plunger 28 of the solenoid. It will be appreciated, however, that if desired, the magnet 48 may be connected directly to the damper lifter tray 11, or to an immediate portion of the trapwork 32. The displacement of the magnet 48 is sensed by a Hall-effect sensor 60, and the velocity of the magnet is sensed by the sense coil 50.

The Hall-effect sensor includes, for example, an electrical conductor through which an electrical current is caused to flow. The presence of a magnet near the conductor gives rise to a voltage difference across the conductor, which may be amplified to form the Hall-effect sensor output voltage. As the magnet recedes from the conductor, the voltage difference, and consequently the output voltage, is reduced in accordance with an inverse square law. Thus, the Hall-effect sensor output voltage is a nonlinear function of the displacement of the magnet. While the Hall-effect sensor can be used to sense displacement of the magnet, the sense coil can be used to sense velocity of the magnet, in accordance with Faraday's Law of Induction. The sense coil output voltage is a linear function of the velocity of the magnet.

The means for controlling the operation of the solenoid 26 is schematically illustrated in FIG. 1, and further details are shown in FIGS. 4-7. Musical performance information is received, for example, from a recorded medium, which may be a Compact Disc, flash drive, computer memory, or the like. Alternatively, the musical performance information may be received via a network. The musical performance information includes data representative of the commanded positions. In operation, the control logic 36 receives the musical performance information and calculates a commanded position. Alternatively, the control logic 36 receives a commanded position. The control logic 36 compares the commanded position with the output of the Hall-effect sensor 60, and calculates a drive, which is used to drive the solenoid 26 or other actuator.

The output of the control logic 36 is used to drive the solenoid 26 or other actuator, causing corresponding movement of the plunger 28 and resulting in movement of the damper lifter tray 11. This movement of the plunger also causes corresponding movement of the magnet 48 within the sense coil 50, and displacement of the magnet 48 with respect to the Hall-effect sensor 60, so that a closed loop feedback control results.

Figure 2:
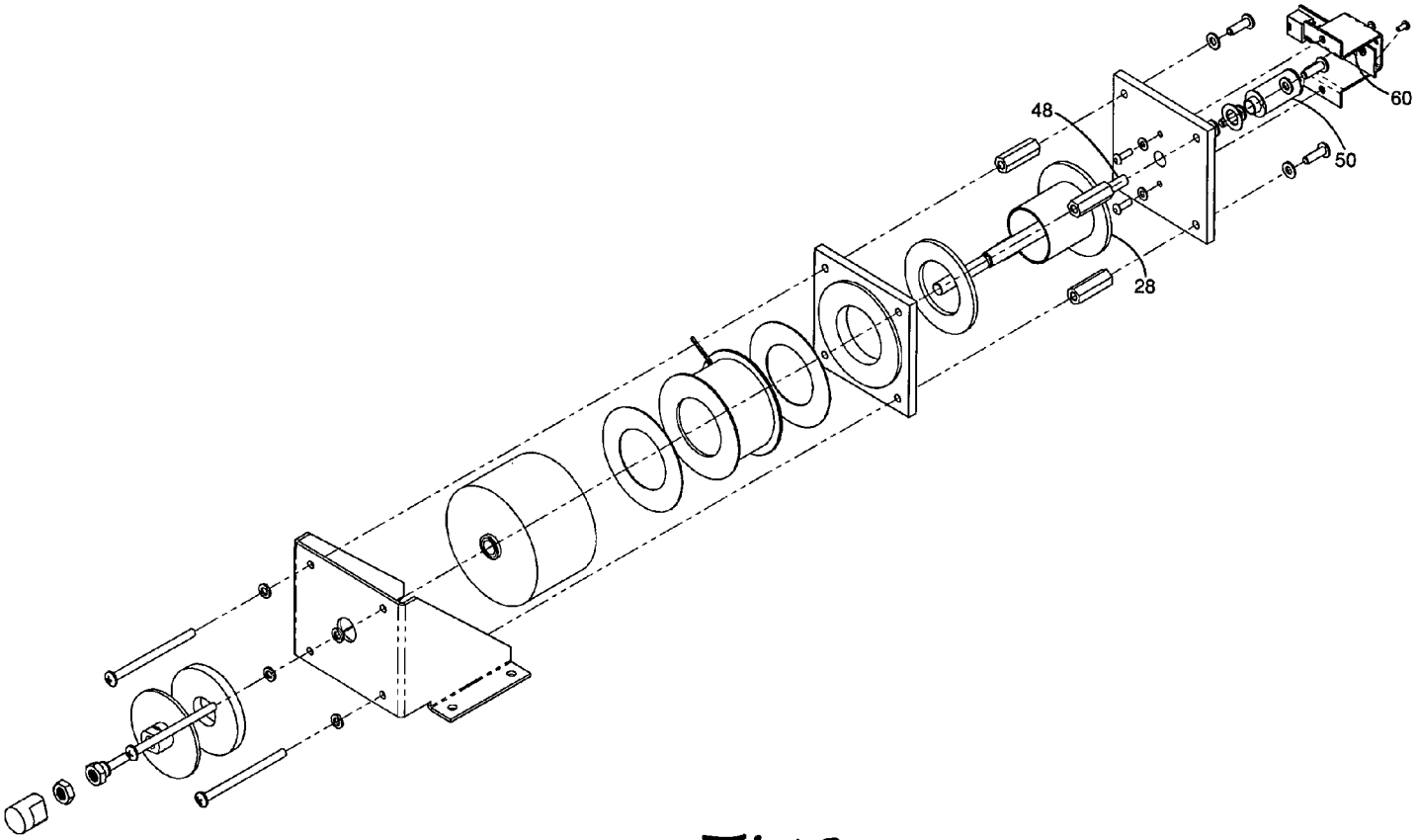
FIG. 2 is an exploded view illustrating an actuator used to drive a pedal, in accordance with an embodiment of the present invention.
Figure 3:
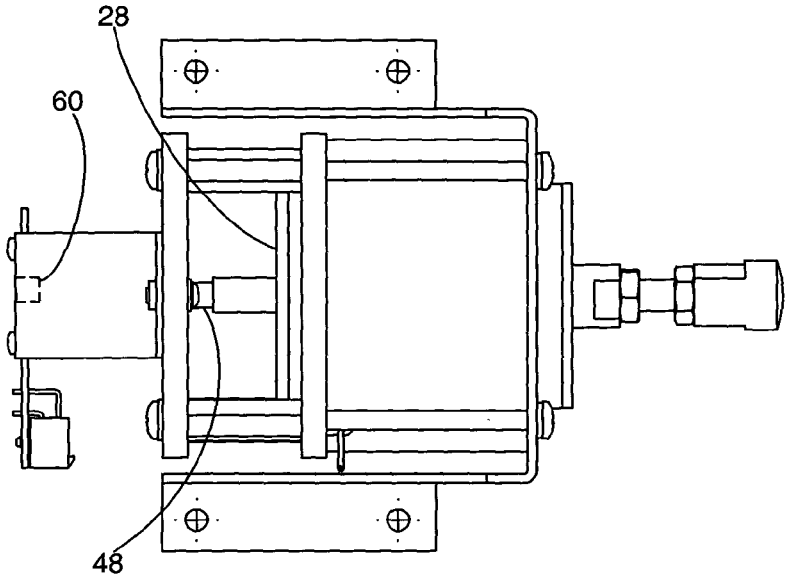
FIG. 3 is a schematic illustrating an actuator used to drive a pedal, in accordance with an embodiment of the present invention.
Figure 3:
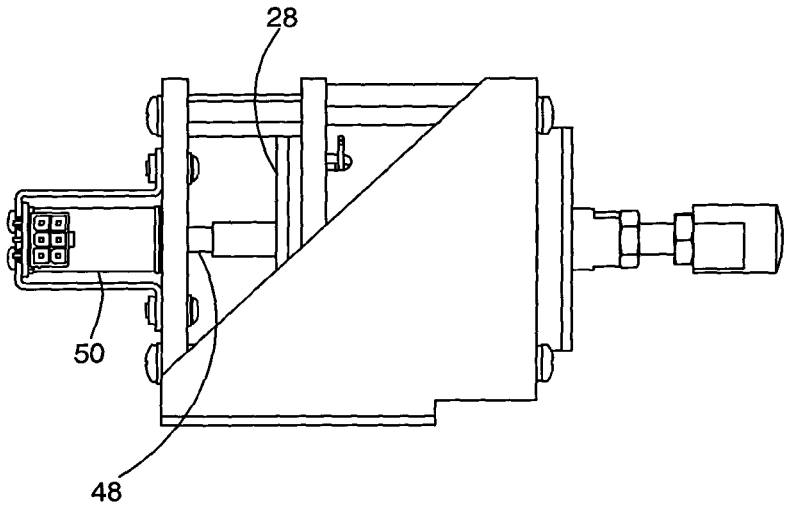

FIG. 2 is an exploded view illustrating an actuator used to drive a pedal, in accordance with an embodiment of the present invention, and FIG. 3 is a schematic illustrating an actuator used to drive a pedal, in accordance with an embodiment of the present invention. As shown in FIGS. 2-3, a magnet 48, such as a cylindrical rare-earth magnet, is affixed to the rear of the plunger 28 of a solenoid with its axis in line with the axis of the plunger. A Hall-effect sensor 60 or other sensor is placed beyond the distal end of the magnet 48, aligned with the axis of the magnet and the plunger. A sense coil 50 is placed such that the distal end of the magnet 48 moves within the sense coil 50 as the plunger 28 moves from its resting position to its fully actuated position.

Figure 4:
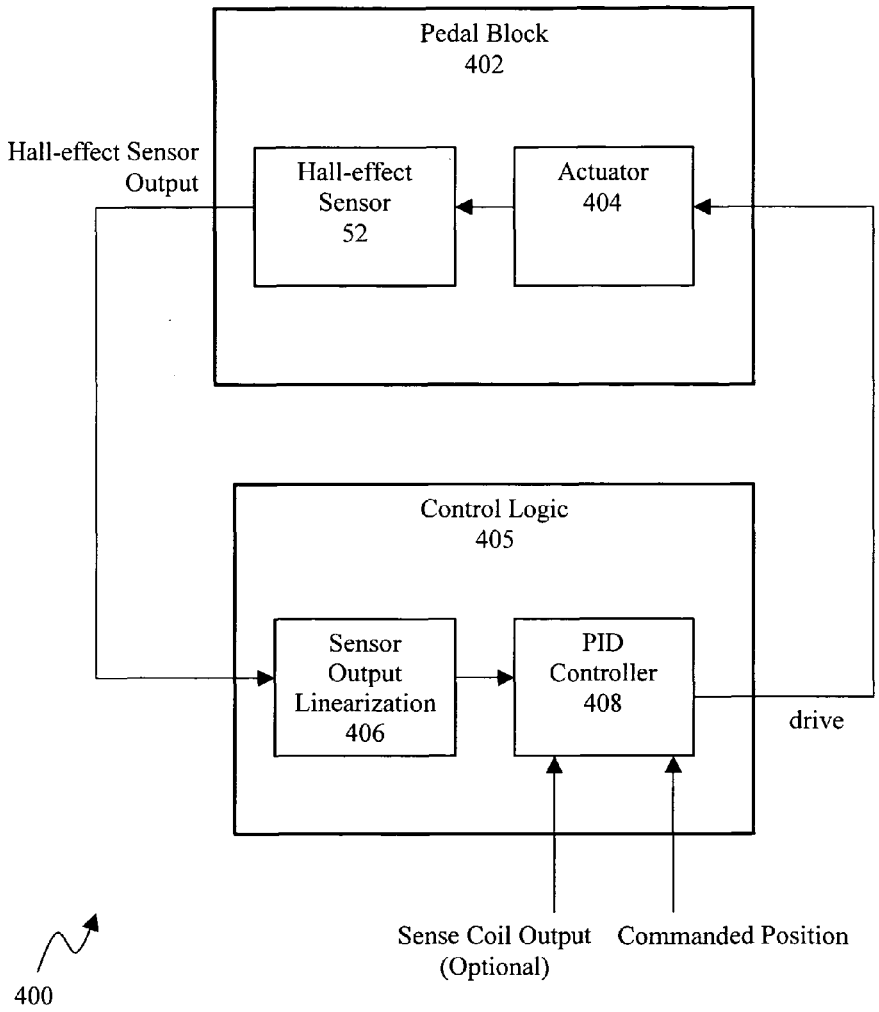
FIG. 4 is a block diagram illustrating a pedal assembly, in accordance with an embodiment of the invention.

FIG. 4 is a block diagram illustrating a pedal assembly 400, in accordance with an embodiment of the invention. As shown in FIG. 4, the pedal assembly 400 may include a pedal block 402, which includes an actuator 404 (such as the solenoid 26 of FIG. 1), which effects movement of a pedal mechanism (not shown); and a Hall-effect sensor 60, which senses displacement of the actuator. For example, the Hall-effect sensor 60 may sense displacement of a magnet affixed to the rear of a plunger.

The pedal assembly 400 may also include control logic 405, which is one implementation of the control logic 36 of FIG. 1. Control logic 405 may be configured to receive commanded position information describing the commanded position of the actuator. Alternatively, control logic 405 may be configured to receive musical performance information and to calculate the commanded position information from the musical performance information.

The control logic 405 may include a sensor output linearization block 406. The sensor output linearization block 406 may be configured to receive the output of the Hall-effect sensor 60, and to calculate an output, known as the "linearized sensor output," that may be effectively compared with the commanded position. Operation of the sensor output linearization block will be described further with reference to FIG. 5.

The control logic 405 may also include a Proportional-Integral-Derivative (PID) controller 408. The PID Controller 408 is well-known in the art. The PID controller 408 receives a commanded position and a sensor output, which must comparable, and calculates a drive. The drive may then be applied to the actuator 404. The function of the Sensor Output Linearization block 406 is to calculate the linearized sensor output, which is comparable to the commanded position, so that the two can be effectively compared by the PID controller 408.

The PID controller 408 may optionally receive a sense coil output, which is, for example, the output of the sense coil 50 of FIGS. 1-3. In calculating a drive, the PID controller may perform three intermediate calculations: a Proportionality calculation, an Integration calculation, and a Derivative calculation. The results of the three intermediate calculations are used to calculate the drive. The Proportionality calculation and the Integration calculation may affect the static accuracy of the actuator, while the Derivative calculation may be used only for stability, or to improve the dynamic accuracy of the actuator. Derivative calculation normally takes the derivative of the position of the actuator, for example, as measured by the Hall-effect sensor 60. As will be appreciated by those skilled in the art, the derivative of position is equivalent to the velocity. The sense coil output is a voltage that is proportional to the velocity of the actuator. Thus, rather than performing a Derivative calculation based on the output of the Hall-effect sensor 60, the PID controller 408 may use the sense coil output to find the velocity of the actuator. This may provide several benefits. For example, the sense coil output is of very high quality, that is, it has a very high signal-to-noise ratio, and consequently, using the sense coil output to determine velocity may result in a relatively accurate result. In contrast, the results of a Derivative calculation based on the output of the Hall-effect sensor 60 may be contaminated by a large amount of noise, reducing the accuracy.

As is shown in FIG. 4, the pedal block 402 and the control logic 405 form a closed-loop control circuit that controls the operation of the actuator 404.

Figure 5:
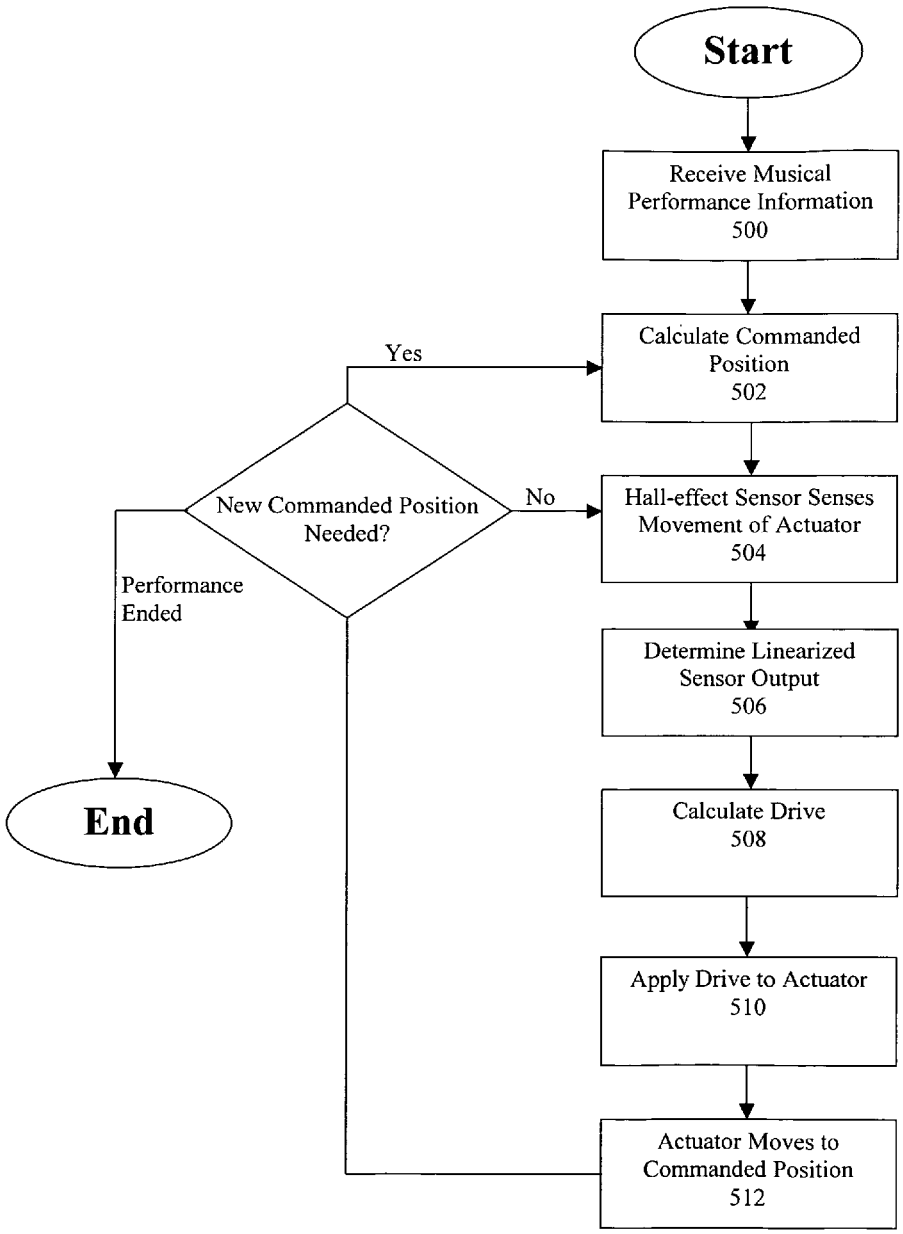
FIG. 5 is a flow chart illustrating a method for controlling a pedal assembly, in accordance with an embodiment of the invention.

FIG. 5 is a flow chart illustrating a method for controlling a pedal assembly. As shown in FIG. 5, the method may begin in step 500, wherein musical performance information may be received, for example, from a recorded medium, from computer memory, or from a network. In step 502, a commanded position may be calculated from the musical performance information. Because these steps may occur outside of the feedback loop shown in FIG. 4, the commanded position information may be calculated in advance and buffered.

In step 504, the Hall-effect sensor may sense the position of the actuator, and in step 506, a linearized sensor output may be determined based on the Hall-effect sensor output. The nonlinearity of Hall-effect sensor derives from the fact that its output voltage is linearly proportional to the strength of an applied magnetic field provided by a permanent magnet. The arrangement shown in FIGS. 1-3 yields a magnetic field strength that is inversely proportional to the square of the distance between the Hall-effect sensor and the magnet. Thus, the output voltage v(out) of a Hall-effect sensor is given by equation (1):

$$v(\text{out})=k/(s+s(0))^2 \quad (1)$$

where k is a constant of proportionality that depends on the sensor, the magnet, and the mechanical construction, s is the displacement, or the distance between the distal end of the magnet and the surface of the Hall-effect sensor, and s(0) is a constant that is determined by the characteristics of the Hall-effect sensor and the mechanical construction.

Thus, the linearized sensor output voltage v(linear), which is linearly proportional to displacement, is found using equation (2):

$$v(\text{linear})=\sqrt{(k/v(\text{out}))}-v(0) \quad (2)$$

The constants k and v(0) depend on the physical construction and settings of the piano, and are determined during a calibration process, as will be described further below with reference to FIG. 8. In one implementation, the calibration process used to determine the constants k and v(0) may be automated. However, in alternate implementations the calibration may be performed with the assistance of a human operator.

Equation (2) may be used to populate a lookup table. The Hall-effect sensor output v(out) may be used as the address of the lookup table, and the linearized sensor output v(linear) may be found by consulting the lookup table. This may increase the speed of the computation and reduce timing issues. In some implementations, there may be fewer values in the lookup table than there are possible values of the input signal, and the linearized sensor output v(linear) is found by interpolation or extrapolation. In other implementations, no lookup table is used. Instead, equation (2) is used to calculate the value of the linearized sensor output v(linear) for a given value of v(out).

In step 508, a drive may be calculated, for example, by a PID controller. The drive is calculated, for example, based on the commanded position and the linearized sensor output. Optionally, a sense coil output may also be used in calculating the drive. In one implementation, the sense coil output may be used to perform a velocity calculation instead of performing a Differentiation calculation. The drive calculated in step 508 may be the drive that is applied to the actuator to move the actuator into the commanded position. In step 510, the drive may be applied to the actuator. In step 512, the actuator moves into the commanded position, effectuating pedaling.

It may then be determined whether a new commanded position is needed. During playback of a musical performance, the commanded position will change based on the desired pedaling. In one implementation, the commanded position will be updated periodically based on the musical performance information. The commanded position may be updated frequently, for example, every 10 ms. Based on the musical performance information and/or the timing circuitry, it may be determined that a new commanded position is needed, that a new commanded position is not needed, or that the musical performance has ended.

If it is determined that a new commanded position is needed, the method may return to step 502. Alternatively, the commanded position may be determined in advance and buffered, so that the calculation of the commanded position in step 502 is performed independently of, or in advance of, the timing of the musical performance. If it is determined that a new commanded position is not needed, the method may return to step 504. If it is determined that the performance has ended, the method may end.

Furthermore, during the performance, the Hall-effect sensor output v(out) will change continuously as the position of the actuator 404 changes. Consequently, the linearized sensor output v(linear) will also change. In one implementation, the linearized sensor output v(linear) will change continuously, for example, if the sensor output linearization block 406 is implemented using analog circuitry. In another implementation, the sensor output linearization block 406 will regularly sample the Hall-effect sensor output v(out) and calculate an updated linearized sensor output v(linear), for example, if the sensor output linearization block 406 is implemented using digital logic.

Figure 6:
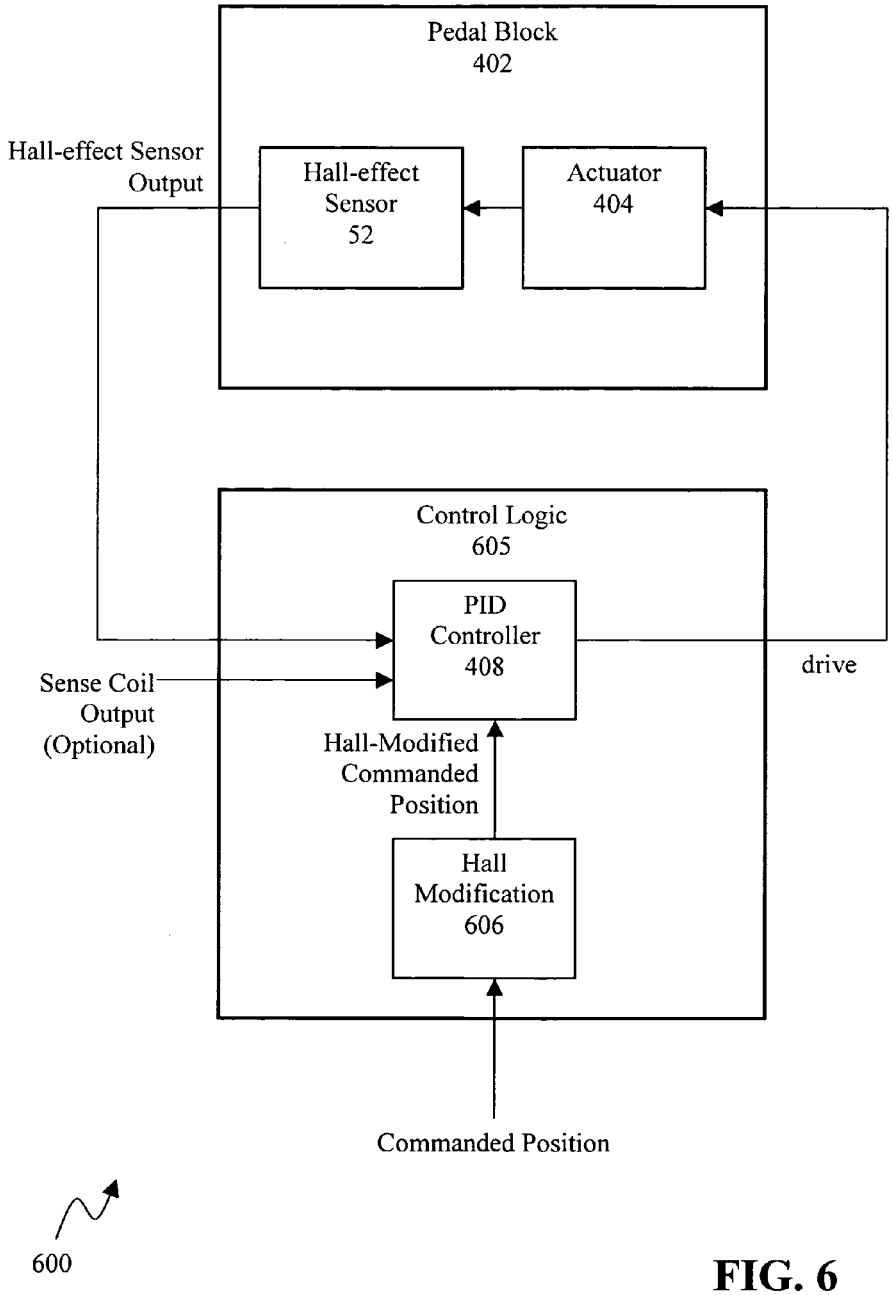
FIG. 6 is a block diagram illustrating a pedal assembly, in accordance with an embodiment of the invention.

FIG. 6 is a block diagram illustrating a pedal assembly 600, in accordance with an embodiment of the invention. As shown in FIG. 6, the pedal assembly 600 may include a pedal block 402, which, as described above with reference to FIG. 4, includes an actuator 404 and a Hall-effect sensor 60, which senses displacement of the actuator.

The pedal assembly 400 may also include control logic 605, which is one implementation of the control logic 36 of FIG. 1. Control logic 605 may be configured to receive commanded position information describing the commanded position of the actuator. Alternatively, control logic 605 may be configured to receive musical performance information and to calculate the commanded position information from the musical performance information.

The control logic 605 may include a Hall modification block 606. The Hall modification block 606 may be configured to receive the commanded position, and to calculate an output, known as the "Hall-modified commanded position," that may be effectively compared with Hall-effect sensor output. Operation of the sensor output linearization block will be described further with reference to FIG. 5.

The control logic 605 may also include a Proportional-Integral-Derivative (PID) controller 408. As described above with reference to FIG. 4, the PID Controller 408 receives a commanded position and a sensor output, which must comparable, and calculates a drive. The drive may then be applied to the actuator 404. The function of the Hall Modification block 606 is to calculate the Hall-modified commanded position, which is comparable to the Hall-effect sensor output, so that the two can be effectively compared by the PID controller 408.

The PID controller 408 may optionally receive a sense coil output, which is, for example, the output of the sense coil 50 of FIGS. 1-3. In calculating a drive, the PID controller may perform three intermediate calculations: a Proportionality calculation, an Integration calculation, and a Derivative calculation. The Proportionality calculation and the Integration calculation may affect the static accuracy of the actuator, while the Derivative calculation may be used only for stability, or to improve the dynamic accuracy of the actuator. The results of the three intermediate calculations are used to calculate the drive. The Derivative calculation normally takes the derivative of the position of the actuator, for example, as measured by the Hall-effect sensor 60. As will be appreciated by those skilled in the art, the derivative of position is equivalent to the velocity. The sense coil output is a voltage that is proportional to the velocity of the actuator. Thus, rather than performing a Derivative calculation based on the output of the Hall-effect sensor 60, the PID controller 408 may use the sense coil output to find the velocity of the actuator. This may provide several benefits. For example, the sense coil output is of very high quality, that is, it has a very high signal-to-noise ratio, which may result in a relatively accurate result, as discussed above with reference to FIG. 4. In addition, there are further benefits to using the sense coil output in the particular implementation shown in FIG. 6, that is, when the Hall-effect sensor output is provided directly to the PID block without modification. Because the Hall-effect sensor output is not linear with respect to position, performing a Derivative calculation based on the Hall-effect sensor output will create a nonlinear velocity term, which may result in an inaccurate drive. The sense-coil output is linear with respect to velocity, so using the sense-coil output to calculate the velocity will result in a linear velocity term, ensuring accurate calculation of the drive.

As is shown in FIG. 6, the pedal block 402 and the control logic 605 form a closed-loop control circuit that controls the operation of the actuator 404.

While the pedal assembly mechanism 400 of FIG. 4 includes a Sensor Output Linearization block 406 that is located within the closed-loop control circuit, the pedal assembly mechanism 600 of FIG. 6 includes a Hall Modification Block 606 that is located outside the closed-loop control circuit. This may provide certain advantages. For example, because the block is located outside the closed-loop control circuit and does not require any real-time information, the calculation of the Hall-modified commanded position may occur in advance and may be buffered. In addition, because the block is located outside the closed-loop control circuit, timing complications within the closed-loop control circuit may be reduced.

Figure 7:
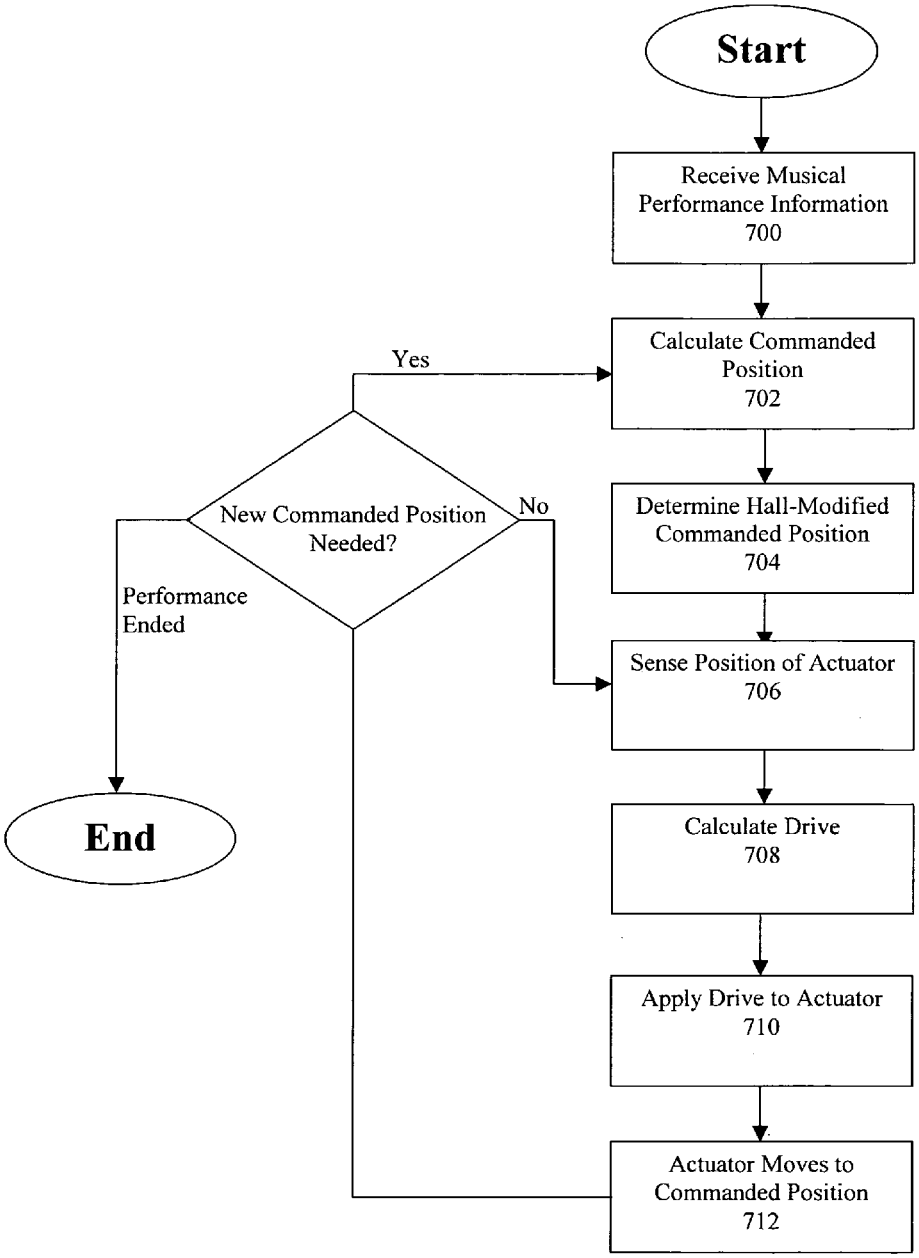
FIG. 7 is a flow chart illustrating a method for controlling a pedal assembly, in accordance with an embodiment of the invention.

FIG. 7 is a flow chart illustrating a method for controlling a pedal assembly. As shown in FIG. 7, the method may begin in step 700, wherein musical performance information may be received, for example, from a recorded medium, from computer memory, or from a network. In step 702, a commanded position may be calculated from the musical performance information. In step 704, the Hall-modified commanded position may be determined, for example, by the Hall Modification block, as will be described below. Because steps 700, 702, and 704 may occur outside of the feedback loop shown in FIG. 7, the Hall-modified commanded position information may be calculated in advance and buffered.

There are several ways in which the Hall-modified commanded position may be determined in step 704. As discussed above with reference to FIG. 5, the output voltage v(out) of a Hall-effect sensor is given by equation (1):

$$v(\text{out})=k/(s+s(0))^2 \tag{1}$$

where k is a constant of proportionality that depends on the sensor, the magnet, and the mechanical construction, s is the displacement of the magnet, or the distance between the distal end of the magnet and the surface of the Hall-effect sensor, and s(0) is a constant that is determined by the characteristics of the Hall-effect sensor and the mechanical construction. The constants k and s(0) may be determined during calibration, as will be discussed further below with reference to FIG. 8.

Thus, the Hall-modified command position voltage v(modified), which is comparable to the Hall-effect sensor output, is found using equation (3):

$$v(\text{modified})=k/(v(\text{command})+v(0))^2 \tag{3}$$

Equation (3) may be used to populate a lookup table. The commanded position v(command) may be used as the address of the lookup table, and the Hall-modified command position voltage v(modified) may be found by consulting the lookup table. This may increase the speed of the computation and reduce timing issues. In some implementations, there may be fewer values in the lookup table than there are possible values of the commanded position, and the Hall-modified command position voltage v(modified) is found by interpolation or extrapolation. In other implementations, no lookup table is used. Instead, equation (3) is used to calculate the Hall-modified command position voltage v(modified) for a given value of the commanded position v(command).

In step 706, the Hall-effect sensor may sense the position of the actuator, and in step 708, a drive may be calculated, for example, by a Proportional-Integral-Derivative (PID) controller. The drive is calculated, for example, based on the Hall-modified commanded position and the Hall-effect sensor output. Optionally, a sense coil output may also be used in calculating the drive. In one implementation, the sense coil output may be used to perform a velocity calculation instead of performing a Differentiation calculation. The drive calculated in step 708 may be the drive that is applied to the actuator to move the actuator into the commanded position. In step 710, the drive may be applied to the actuator. In step 712, the actuator moves into the commanded position, effectuating pedaling.

It may then be determined whether a new commanded position is needed. During playback of a musical performance, the commanded position will change based on the desired pedaling. In one implementation, the commanded position will be updated periodically based on the musical performance information. The commanded position may be updated frequently, for example, every 10 ms. Based on the musical performance information and/or the timing circuitry, it may be determined that a new commanded position is needed, that a new commanded position is not needed, or that the musical performance has ended.

If it is determined that a new commanded position is needed, the method may return to step 702 and subsequently continue in step 704. Alternatively, the commanded position and Hall-modified commanded position may be determined in advance and buffered, so that the calculation of the commanded position in step 702 and the Hall-modified commanded position in step 704 are performed independently of, or in advance of, the timing of the musical performance. If it is determined that a new commanded position is not needed, the method may return to step 706. If it is determined that the performance has ended, the method may end.

Furthermore, during the performance, the Hall-effect sensor output v(out) will change continuously as the position of the actuator 404 changes. Consequently, the linearized sensor output v(linear) will also change. In one implementation, the linearized sensor output v(linear) will change continuously, for example, if the sensor output linearization block 406 is implemented using analog circuitry. In another implementation, the sensor output linearization block 406 will regularly sample the Hall-effect sensor output v(out) and calculate an updated linearized sensor output v(linear), for example, if the sensor output linearization block 406 is implemented using digital logic.

Figure 8:
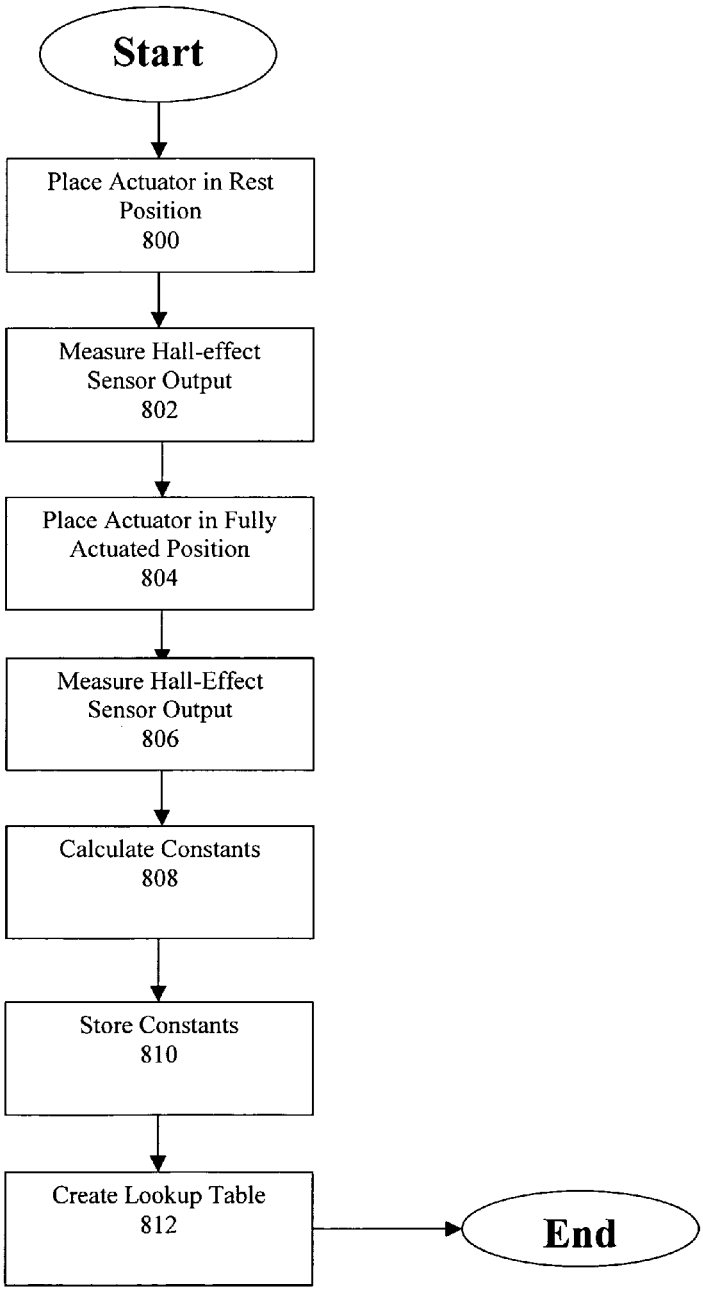
FIG. 8 is a flow chart illustrating a method for automatic calibration of a pedal assembly, in accordance with an embodiment of the invention.

FIG. 8 is a flow chart illustrating a method for automatic calibration of a pedal assembly. As described above, the Hall-effect sensor output is related to the linear position, or displacement s, by equation (1):

$$v(\text{out})=k/(s+s(0))^2 \tag{1}$$

where k is a constant of proportionality that depends on the sensor, the magnet, and the mechanical construction, s is the distance between the distal end of the magnet and the surface of the Hall-effect sensor, and s(0) is a constant that is determined by the characteristics of the Hall-effect sensor and the mechanical construction.

The constants k and s(0) may vary greatly depending on the physical construction of the actuator, the physical construction of the piano, and the personalized user preferences made when adjusting the sound of the piano. Slight modifications in the physical construction of the actuator or the piano may affect the values of the constants k and s(0). In addition, user preferences may affect the values of the constants k and s(0). For example, some piano owners may prefer to adjust the piano to provide "dry," or minimally sustained, pedaling, while other piano owners prefer to adjust the piano to provide pedaling with longer sustain. Such preferences can be made, for example, by professional piano tuners, or by the owners themselves, by adjusting certain mechanical components of the piano.

Calibration of the pedal assembly may occur, for example, during or after installation of the pedal assembly, after moving the piano, after tuning or adjusting the piano, after making repairs to the piano or pedal assembly, or at any other appropriate time. Calibration of the pedal assembly may include testing the pedal assembly to calculate values of k and s(0). In embodiments of the present invention, calibration of the pedal assembly may be fully automated. In alternate embodiments, calibration of the pedal assembly may be partially or fully performed by a human operator.

A method for calibration of a pedal assembly is shown in FIG. 8. The method shown in FIG. 8 may be used to calibrate a pedal assembly using a nonlinear sensor, such as a Hall-effect sensor. The method may begin in step 800 in FIG. 8, wherein the actuator may be placed in a resting position (that is, there is no drive to the actuator and the pedal mechanism is not engaged). The method may continue in step 802, wherein Hall-effect sensor output is measured while the actuator is in the resting position. The method may continue in step 804, wherein the actuator may be placed in a fully actuated position (that it, a very large drive or a maximum drive is provided to the actuator such that the pedal mechanism is fully engaged). The method may continue in step 806, wherein Hall-effect sensor output is measured while the actuator is in the fully actuated position. The method may continue in step 808, wherein the constants are calculated. In step 810, the constants may be stored. In step 812, one or more lookup tables may be created using the constants, for example, as described above with reference to FIGS. 5 and 7. In creating a linearized sensor output or a Hall-modified command position, various implementations may use lookup tables, mathematical formulas, or both lookup tables and mathematical formulas. If only lookup tables are used, the step of storing the constants 810 may be eliminated in some implementations. If only mathematical formulas are used, the step of creating the lookup tables 812 may be eliminated. Furthermore, those skilled in the art will appreciate that the steps of the calibration may be performed in different orders. For example, the actuator may first be placed in the fully actuated position, and subsequently may be placed in the resting position.

As described above, the Hall-effect sensor output is related to displacement s by equation (1):

$$v(\text{out})=k/(s+s(0))^2 \tag{1}$$

Thus, for the resting position and the fully actuated position, the Hall-effect sensor outputs are given by equations (4) and (5), respectively:

$$v(\text{rest})=k/(s(\text{rest})+s(0))^2 \tag{4}$$

$$v(\text{actuate})=k/(s(\text{actuate})+s(0))^2 \tag{5}$$

The goal of calibration is for the commanded positions to accurately drive the actuator to effect the desired position. Thus, for an appropriately calibrated system, the minimum commanded position will cause the actuator to be located at the resting position s(rest), and the maximum commanded position will cause the actuator to be located at the fully actuated position s(actuate). Therefore, in order to appropriately calibrate the pedal assembly, the resting position s(rest) can be set to be equal to the minimum commanded position, and the fully actuated position s(actuate) can be set to be equal to the maximum commanded position. The minimum and maximum commanded positions are defined in the protocols used for recording and playback. Therefore, the minimum and maximum commanded positions are known for any particular implementation.

Because s(rest) and s(actuate) are known from the protocols used, we have two equations in the two unknowns k and s(0). Solving yields $$s(0)=((m*s(\text{actuate}))-s(\text{rest}))/(1-m),$$

$$k=v(\text{rest})*(s(\text{rest})+s(0))^2$$

where $m=\sqrt{(v(\text{actuate})/v(\text{rest}))}$.

Figure 9:
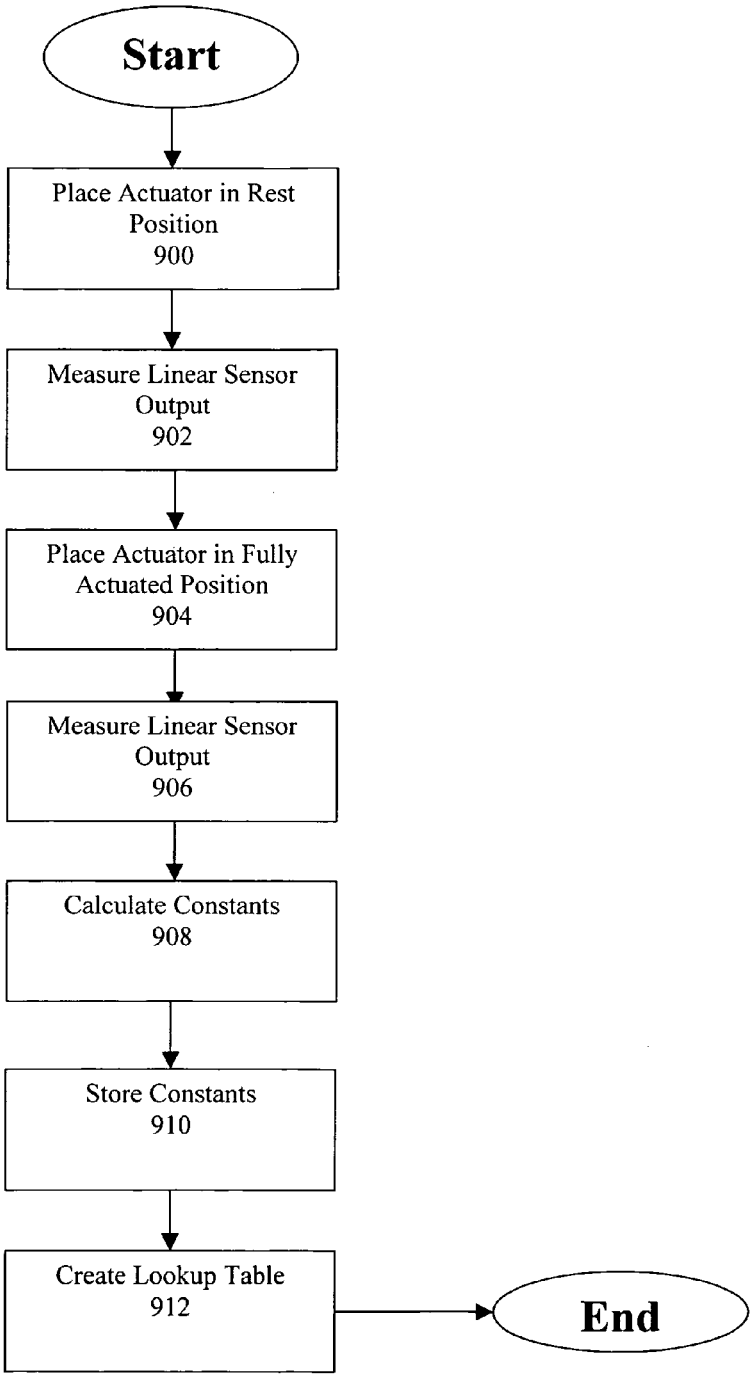
FIG. 9 is a flow chart illustrating a method for automatic calibration of a pedal assembly, in accordance with an embodiment of the invention.

A method for calibration of a pedal assembly is shown in FIG. 9. The method shown in FIG. 9 may be used to calibrate a pedal assembly using a linear sensor, such as a linear potentiometer. The method may begin in step 900 in FIG. 9, wherein the actuator may be placed in a resting position (that is, there is no drive to the actuator and the pedal mechanism is not engaged). The method may continue in step 902, wherein linear sensor output is measured while the actuator is in the resting position. The method may continue in step 904, wherein the actuator may be placed in a fully actuated position (that it, a very large drive or a maximum drive is provided to the actuator such that the pedal mechanism is fully engaged). The method may continue in step 906, wherein linear sensor output is measured while the actuator is in the fully actuated position. The method may continue in step 908, wherein the constants are calculated. In step 910, the constants may be stored. In step 912, one or more lookup tables may be created using the constants, in a similar manner to that described above with reference to FIGS. 5 and 7. Various implementations may use lookup tables, mathematical formulas, or both lookup tables and mathematical formulas. If only lookup tables are used, the step of storing the constants 910 may be eliminated in some implementations. If only mathematical formulas are used, the step of creating the lookup tables 912 may be eliminated. Furthermore, those skilled in the art will appreciate that the steps of the calibration may be performed in different orders. For example, the actuator may first be placed in the fully actuated position, and subsequently may be placed in the resting position.

The output of a linear potentiometer v(pot) is related to displacement s by equation (6):

$$v(\text{pot})=a*s+b \tag{6}$$

Thus, for the resting position and the fully actuated position, outputs of the linear potentiometer are given by equations (7) and (8), respectively:

$$v(\text{rest})=a*(s(\text{rest}))+b \tag{7}$$

$$v(\text{actuate})=a*(s(\text{actuate}))+b \tag{8}$$

The goal of calibration is for the commanded positions to accurately drive the actuator to effect the desired position. Thus, for an appropriately calibrated system, the minimum commanded position will cause the actuator to be located at the resting position s(rest), and the maximum commanded position will cause the actuator to be located at the fully actuated position s(actuate). Therefore, in order to appropriately calibrate the pedal assembly, the rest position s(rest) can be set to be equal to the minimum commanded position, and the fully actuated position s(actuate) can be set to be equal to the maximum commanded position. The minimum and maximum commanded positions are defined in the protocols used for recording and playback. Therefore, the minimum and maximum commanded positions are known for any particular implementation.

Because s(rest) and s(actuate) are known from the protocols used, we have two equations in the two unknowns a and b Solving yields:

$$a=(v(\text{actuate})-v(\text{rest}))/(s(\text{actuate})-s(\text{rest}))$$

$$b=v(\text{actuate})-(s(\text{actuate})*(v(\text{actuate})-v(\text{rest})))/(s(\text{actuate})-s(\text{rest}))$$

It will be appreciated that, according to embodiments of the present invention, the pedal assembly may be calibrated automatically. In this case, drive may be automatically applied to and withdrawn from the actuator, the Hall-effect sensor outputs may be measured, calculations may be made, and the result of the calculations may be stored, all without the intervention of a human operator. Furthermore, if a lookup table is to be used with the present invention, the lookup table may be created automatically based on the calculated values. This may greatly simplify the installation and maintenance of the pedal assembly.

What is claimed is:

1. An actuator assembly used to drive a mechanical portion of a musical instrument, comprising:

an actuator operable to drive the mechanical portion of the musical instrument;

a nonlinear sensor operable to sense a displacement of an element movable by of the actuator;

control logic operable to calculate a drive to be applied to the actuator, the drive being calculated based on a commanded position and an output of the nonlinear sensor; and wherein the control logic determines a velocity, wherein the velocity is used to stabilize the drive.

2. The actuator assembly of claim 1, wherein the output of the nonlinear sensor is proportional to the inverse square of the distance from the nonlinear sensor to the moveable element.

3. The actuator assembly of claim 1, wherein the nonlinear sensor is an optical sensor.

4. The actuator assembly of claim 1, wherein the nonlinear sensor is a Hall-effect sensor.

5. The actuator assembly of claim 1, wherein the control logic contains a sensor output linearization block operable to find a linearized value based on the output of the nonlinear sensor.

6. The actuator assembly of claim 5, wherein the sensor output linearization block calculates the linearized value according to the equation:

$$v(\text{linear})=\sqrt{(k/v(\text{out}))}-v(0)$$

where v(linear) is the linearized value, v(out) is the output of the nonlinear sensor, and k and v(0) are constants.

7. The actuator assembly of claim 5, wherein the sensor output linearization block finds the linearized value using a lookup table.

8. The actuator assembly of claim 1, wherein the control logic contains a modification block operable to find a modified value based on the commanded position, the modified value being comparable to the output of the nonlinear sensor.

9. The actuator assembly of claim 8, wherein the modified value is a Hall-modified value.

10. The actuator assembly of claim 8, wherein the modification block calculates the modified value according to the equation:

$$v(\text{modified})=k/(v(\text{command})+v(0))^2$$

where v(modified) is the modified value, v(command) is the commanded position, and k and v(0) are constants.

11. The actuator assembly of claim 8, wherein the modification block finds the modified value using a lookup table.

12. The actuator assembly of claim 1, wherein the drive is calculated based on the commanded position and a linearized value, the linearized value being based on the output of the nonlinear sensor.

13. The actuator assembly of claim 1, wherein the drive is calculated based on a modified value and the output of the nonlinear sensor, the modified value being based on the commanded value.

14. The actuator assembly of claim 1, wherein the commanded position is the desired position of the moveable element.

15. The actuator assembly of claim 1, wherein the musical instrument is a piano, and the mechanical portion of the musical instrument is a pedal mechanism in the piano.

16. An actuator assembly used to drive a mechanical portion of a musical instrument, comprising:

an actuator operable to drive the mechanical portion of the musical instrument;

a nonlinear sensor operable to sense a displacement of a moveable element of the actuator assembly; and control logic operable to calculate a drive to be applied to the actuator, the drive being calculated based on a commanded position and an output of the nonlinear sensor, wherein the control logic contains a controller that determines a velocity, wherein the velocity is used to stabilize the drive.

17. The actuator assembly of claim 16, wherein the moveable element is a moveable element of the actuator.

18. The actuator assembly of claim 16, wherein the moveable element is the mechanical portion of the musical instrument.

19. The actuator assembly of claim 16, further comprising a sense coil, wherein the velocity is based on the output of the sense coil.

20. A control circuit used to calculate a drive to be provided to an actuator, comprising:

control logic operable to calculate a drive to be applied to the actuator, the drive being calculated based on a commanded position and an input received from a nonlinear sensor, the nonlinear sensor operable to sense a displacement of a moveable element of the actuator; and wherein the control logic determines a velocity, wherein the velocity is used to stabilize the drive.

21. The control circuit of claim 20, wherein the control logic contains a sensor output linearization block operable to find a linearized value based on the input.

22. The control circuit of claim 21, wherein the sensor output linearization block calculates the linearized value according to the equation:

$$v(\text{linear})=\sqrt{(k/v(\text{out}))}-v(0)$$

where v(linear) is the linearized value, v(out) is the input, and k and v(0) are constants.

23. The control circuit of claim 21, wherein the sensor output linearization block finds the linearized value using a lookup table.

24. The control circuit of claim 20, wherein the control logic contains a modification block operable to find a modified value based on the commanded position, the modified value being comparable to the input.

25. The control circuit of claim 24, wherein the modified value is a Hall-modified value.

26. The control circuit of claim 24, wherein the modification block calculates the modified value according to the equation:

$$v(\text{modified})=k/(v(\text{command})+v(0))^2$$

where v(modified) is the modified value, v(command) is the commanded position, and k and v(0) are constants.

27. The control circuit of claim 24, wherein the modification block finds the modified value using a lookup table.

28. The control circuit of claim 20, wherein the nonlinear sensor is an optical sensor.

29. The control circuit of claim 20, wherein the nonlinear sensor is a Hall-effect sensor.

30. A control circuit used to calculate a drive to be provided to an actuator, comprising:

control logic operable to calculate a drive to be applied to the actuator, the drive being calculated based on a commanded position and an input received from a nonlinear sensor, wherein the control logic contains a controller that determines a velocity, wherein the velocity is used to stabilize the drive.

31. The control circuit of claim 30, wherein the Proportional-Integral-Derivative controller calculates the drive based on the commanded position and a linearized value, the linearized value being based on the input.

32. The control circuit of claim 30, wherein the Proportional-Integral-Derivative controller calculates the drive based on a modified value and the input, the modified value being based on the commanded value.

33. The control circuit of claim 30, wherein the velocity is based on a measurement from a sense coil.

34. The control circuit of claim 30, wherein the nonlinear sensor is operable to sense a displacement of an element moveable by the actuator.

35. A method for calculating a drive to be applied to an actuator, the method comprising:

receiving a nonlinear sensor output from a nonlinear sensor, the nonlinear sensor operable to sense a displacement of an element moveable by of the actuator;

receiving a commanded position;

calculating a drive to be applied to the actuator based on the nonlinear sensor output and the commanded position; and determining a velocity, wherein the velocity is used to stabilize the drive.

36. The method of claim 35, wherein the nonlinear sensor output is proportional to the inverse square of the distance from the nonlinear sensor to the moveable element.

37. The method of claim 35, wherein the nonlinear sensor is an optical sensor.

38. The method of claim 35, wherein the nonlinear sensor is a Hall-effect sensor.

39. The method of claim 35, further comprising finding a linearized value based on the nonlinear sensor output.

40. The method of claim 39, wherein finding a linearized value comprises calculating the linearized value according to the equation:

$$v(\text{linear})=\sqrt{(k/v(\text{out}))}-v(0)$$

where v(linear) is the linearized value, v(out) is the nonlinear sensor output, and k and v(0) are constants.

41. The method of claim 39, wherein finding the linearized value comprises:

finding the linearized value using a lookup table.

42. The method of claim 35, further comprising finding a modified value based on the commanded position, the modified value being comparable to the nonlinear sensor output.

43. The method of claim 42, wherein the modified value is a Hall-modified value.

44. The method of claim 42, wherein finding the modified value comprises calculating the modified value according to the equation:

$$v(\text{modified})=k/(v(\text{command})+v(0))^2$$

where v(modified) is the modified value, v(command) is the commanded position, and k and v(0) are constants.

45. The method of claim 42, wherein finding the modified value comprises:

finding the modified value using a lookup table.

46. The method of claim 35, wherein the drive is calculated based on the commanded position and a linearized value, the linearized value being based on the nonlinear sensor output.

47. The method of claim 35, wherein the drive is calculated based on a modified value and the nonlinear sensor output, the modified value being based on the commanded value.

48. The method of claim 35, wherein the commanded position is the desired position of the moveable element.

49. The method of claim 35, further comprising applying the drive to the actuator.

50. The method of claim 35, wherein the actuator effects movement of a pedal mechanism in a piano.

51. A method for calculating a drive to be applied to an actuator, the method comprising:

receiving a nonlinear sensor output from a nonlinear sensor, the nonlinear sensor operable to sense a displacement of a moveable element of an actuator assembly;

receiving a commanded position; and calculating a drive to be applied to the actuator based on the nonlinear sensor output and the commanded position; and determining a velocity, wherein the velocity is used to stabilize the drive.

52. The method of claim 51, wherein the moveable element is a pedal mechanism in a piano.

53. The method of claim 51, wherein the moveable element is the actuator.

54. The method of claim 51, wherein the velocity is based on the output of a sense coil.

55. A computer-readable medium encoded with instructions executable to perform a method comprising:

receiving a nonlinear sensor output from a nonlinear sensor, the nonlinear sensor operable to sense displacement of an element moveable by of the actuator;

receiving a commanded position;

calculating a drive to be applied to the actuator based on the nonlinear sensor output and the commanded position; and determining a velocity, wherein the velocity is used to stabilize the drive.

56. The computer-readable medium of claim 55, wherein the nonlinear sensor output is proportional to the inverse square of the distance from the nonlinear sensor to the moveable element.

57. The computer-readable medium of claim 55, wherein the nonlinear sensor is an optical sensor.

58. The computer-readable medium of claim 55, wherein the nonlinear sensor is a Hall-effect sensor.

59. The computer-readable medium of claim 55, wherein the method further comprises finding a linearized value based on the nonlinear sensor output.

60. The computer-readable medium of claim 59, wherein finding a linearized value comprises calculating the linearized value according to the equation:

$$v(\text{linear})=\sqrt{(k/v(\text{out}))}-v(0)$$

where v(linear) is the linearized value, v(out) is the nonlinear sensor output, and k and v(0) are constants.

61. The computer-readable medium of claim 59, wherein finding the linearized value comprises:

finding the linearized value using a lookup table.

62. The computer-readable medium of claim 55, wherein the method further comprises finding a modified value based on the commanded position, the modified value being comparable to the nonlinear sensor output.

63. The computer-readable medium of claim 62, wherein the modified value is a Hall-modified value.

64. The computer-readable medium of claim 62, wherein finding the modified value comprises calculating the modified value according to the equation:

$$v(\text{modified})=k/(v(\text{command})+v(0))^2$$

where v(modified) is the modified value, v(command) is the commanded position, and k and v(0) are constants.

65. The computer-readable medium of claim 62, wherein finding the modified value comprises:

finding the modified value using a lookup table.

66. The computer-readable medium of claim 55, wherein the drive is calculated based on the commanded position and a linearized value, the linearized value being based on the nonlinear sensor output.

67. The computer-readable medium of claim 55, wherein the drive is calculated based on a modified value and the nonlinear sensor output, the modified value being based on the commanded value.

68. The actuator assembly of claim 55, wherein the commanded position is the desired position of the moveable element.

69. The computer-readable medium of claim 55, wherein the actuator effects movement of a pedal mechanism in a piano.

70. A computer-readable medium encoded with instructions executable to perform a method comprising:

receiving a nonlinear sensor output from a nonlinear sensor, the nonlinear sensor operable to sense displacement of a moveable element of an actuator assembly;

receiving a commanded position; and calculating a drive to be applied to an actuator based on the nonlinear sensor output and the commanded position; and determining a velocity, wherein the velocity is used to stabilize the drive.

71. The computer-readable medium of claim 70, wherein the moveable element is a pedal mechanism in a piano.

72. The computer-readable medium of claim 70, wherein the moveable element is a moveable element of the actuator.

73. The computer-readable medium of claim 70, wherein the velocity is based on the output of a sense coil.

* * * * *